US008840423B2

(12) United States Patent
Hoshi et al.

(10) Patent No.: US 8,840,423 B2
(45) Date of Patent: Sep. 23, 2014

(54) ELECTRONIC APPARATUS

(75) Inventors: Masahiko Hoshi, Katsushika (JP); Shinji Aoki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 55 days.

(21) Appl. No.: 13/559,902

(22) Filed: Jul. 27, 2012

(65) Prior Publication Data

US 2013/0084756 A1 Apr. 4, 2013

(30) Foreign Application Priority Data

Sep. 30, 2011 (JP) ..... 2011-218062

(51) Int. Cl.

| | |
|---|---|
| ***H01R 13/64*** | (2006.01) |
| ***H01R 12/79*** | (2011.01) |
| ***H01R 13/648*** | (2006.01) |
| ***H01R 13/516*** | (2006.01) |
| ***H01R 24/56*** | (2011.01) |

(52) U.S. Cl.

CPC ..... *H01R 24/56* (2013.01); *H01R 12/79* (2013.01); *H01R 13/648* (2013.01); *H01R 2201/06* (2013.01); *H01R 13/516* (2013.01)

USPC ..... 439/374; 439/63; 361/679.4

(58) Field of Classification Search

USPC ..... 439/675, 63, 76.1, 374, 925; 361/679.4

See application file for complete search history.

(56) References Cited

U.S. PATENT DOCUMENTS

| | | | | |
|---|---|---|---|---|
| 6,835,082 | B2 * | 12/2004 | Gonnering | 439/218 |
| 6,881,082 | B2 * | 4/2005 | Jordan et al. | 439/188 |
| 6,881,098 | B2 * | 4/2005 | Jeansonne et al. | 439/638 |
| 7,118,383 | B2 * | 10/2006 | Nagata et al. | 439/63 |
| 7,217,137 | B1 * | 5/2007 | Nakagawa | 439/63 |
| 7,483,262 | B2 * | 1/2009 | Yin et al. | 361/679.01 |
| 7,819,702 | B2 * | 10/2010 | Murakami | 439/660 |
| 7,963,808 | B2 * | 6/2011 | Miyamoto | 439/677 |
| 8,079,864 | B2 * | 12/2011 | Lin et al. | 439/344 |
| 8,096,837 | B2 * | 1/2012 | Kan et al. | 439/638 |
| 8,430,683 | B2 * | 4/2013 | Kurakagi | 439/374 |
| 8,506,327 | B2 * | 8/2013 | Jol | 439/587 |
| 8,553,398 | B2 * | 10/2013 | Tatsukami | 361/679.02 |
| 2003/0220009 | A1 * | 11/2003 | Takeguchi et al. | 439/374 |
| 2007/0218731 | A1 * | 9/2007 | Tanaka et al. | 439/165 |
| 2012/0035804 | A1 * | 2/2012 | Roberts | 701/33.2 |

FOREIGN PATENT DOCUMENTS

JP 2004-087185 A 3/2004

* cited by examiner

*Primary Examiner* — Neil Abrams
*Assistant Examiner* — Travis Chambers
(74) *Attorney, Agent, or Firm* — Maschoff Brennan

(57) ABSTRACT

An electronic apparatus, includes: a housing including a metallic outer wall part on which an insertion hole to a plug electrode part of a power plug being inserted is formed; a power connector which is stored in the housing and coupled to the plug electrode part inserted into the housing through the insertion hole; and an insulating stopper part which includes a facing surface facing an outer circumference surface of the plug electrode part with a gap, which is smaller than the gap between the outer circumference surface of the plug electrode part and an inner circumference surface of the insertion hole, and which is allocated between the outer wall part and the power connector.

9 Claims, 9 Drawing Sheets

ELECTRONIC APPARATUS

CROSS-REFERENCE TO RELATED APPLICATIONS

This application is based upon and claims the benefit of priority from the prior Japanese Patent Application No. 2011-218062, filed on Sep. 30, 2011, the entire contents of which are incorporated herein by reference.

FIELD

The embodiments discussed herein are related to an electronic apparatus.

BACKGROUND

A notebook-size personal computer (hereinafter referred to as "notebook personal computer") includes a housing and a power connector to which a power plug is inserted through an insertion hole formed in the housing and is stored in the housing.

An earphone plug coupling device includes an earphone jack that is stored in the housing of the electronic apparatus and an earphone plug that is inserted to the earphone jack through the insertion hole formed in the housing.

The related technique is disclosed in Japanese Laid-open Patent Publication No. 2004-087185.

SUMMARY

According to one aspect of the embodiments, an electronic apparatus, includes: a housing including a metallic outer wall part on which an insertion hole to a plug electrode part of a power plug being inserted is formed; a power connector which is stored in the housing and coupled to the plug electrode part inserted into the housing through the insertion hole; and an insulating stopper part which includes a facing surface facing an outer circumference surface of the plug electrode part with a gap, which is smaller than the gap between the outer circumference surface of the plug electrode part and an inner circumference surface of the insertion hole, and which is allocated between the outer wall part and the power connector.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

If a sealing member formed in a circular cylinder shape made by silicon rubber is inserted into an insertion hole formed in a housing, damage of a coupling part between an earphone jack and a circuit substrate may be reduced.

If an electrode part is displaced in a radial direction while the electrode part formed in a cylinder shape of a power plug is inserted into a power connector, the electrode part may touch an inner circumference surface of the insertion hole formed in a metallic housing.

Although the sealing member formed in a circular cylinder shape may be inserted into the insertion hole, exposure of the sealing member to the outside of the housing may affect the appearance of the housing.

Figure 1:
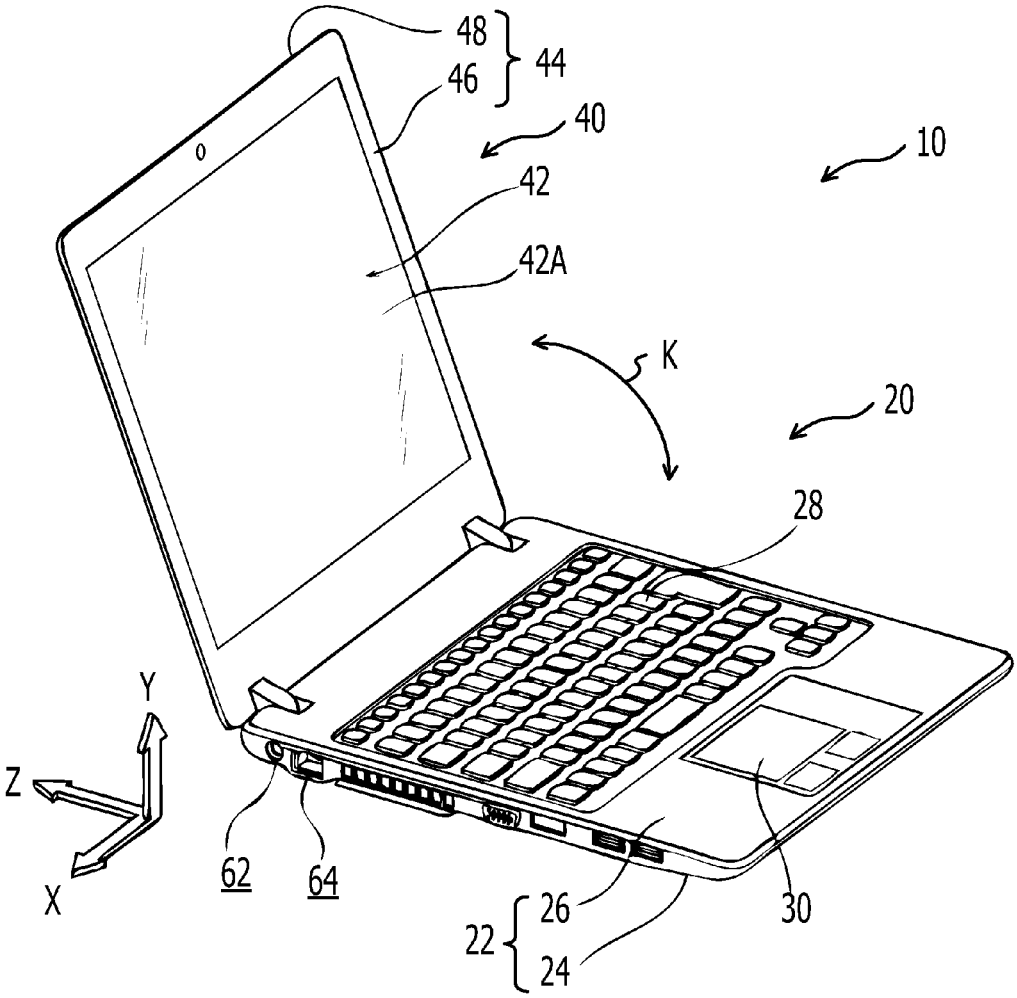
FIG. 1 illustrates an exemplary perspective diagram of an electronic apparatus.

FIG. 1 illustrates an exemplary perspective diagram of an electronic apparatus. The electronic apparatus illustrated in FIG. 1 may be a notebook personal computer, for example. As illustrated in FIG. 1, a notebook personal computer 10 includes a main body device 20 and a display device 40 that is supported to be openable and closable in an arrow K direction through a hinge unit, which is not illustrated, in a rear part of the main body device 20. The display device 40 may be placed in a closing position layered on the main body device 20 or an opening position stood on the main body device 20.

FIG. 1 illustrates a state in which the display device 40 is positioned in the opening position. An arrow X direction illustrated in FIG. 1 may correspond to the outside (left side) of the width direction of the main body device 20. An arrow Y direction illustrated in FIG. 1 may correspond to the upper side of the vertical direction of the main body device 20. An arrow Z direction illustrated in FIG. 1 may correspond to the rear side of the front-back direction of the main body device 20.

The display device 40 includes a display panel 42 and a housing 44 that stores the display panel 42. A front surface of the display panel 42 may correspond to a display surface 42A on which an image, a video, and the like are displayed. The housing 44 includes a front cover 46 that covers an outer circumference part of the display surface 42A of the display panel 42 and a back cover 48 that covers a back surface of the display panel 42. The housing 44 includes a front cover 46 that covers an outer circumference part of the display surface 42A of the display panel 42 and a back cover 48 that covers a back surface of the display panel 42. The front cover 46 is formed in a frame shape, and the display surface 42A of the display panel 42 is exposed from inside the front cover 46.

The main body device 20 includes a housing 22. The housing 22 includes a lower cover 24, which is made from metal and formed in a box shape with an opening on the upper surface, and an upper cover 26 made from metal that closes the opening of the lower cover 24. The housing 22 stores a circuit substrate (main board) on which an electronic apparatus such as a Central Processing Unit (CPU), which is not illustrated, and the like are mounted. The housing 22 stores an input device such as a keyboard 28 or a pointing device such as a touch pad 30. The keyboard 28 and the touch pad 30 may be exposed from the opening formed on the upper cover 26, respectively.

Figure 2:
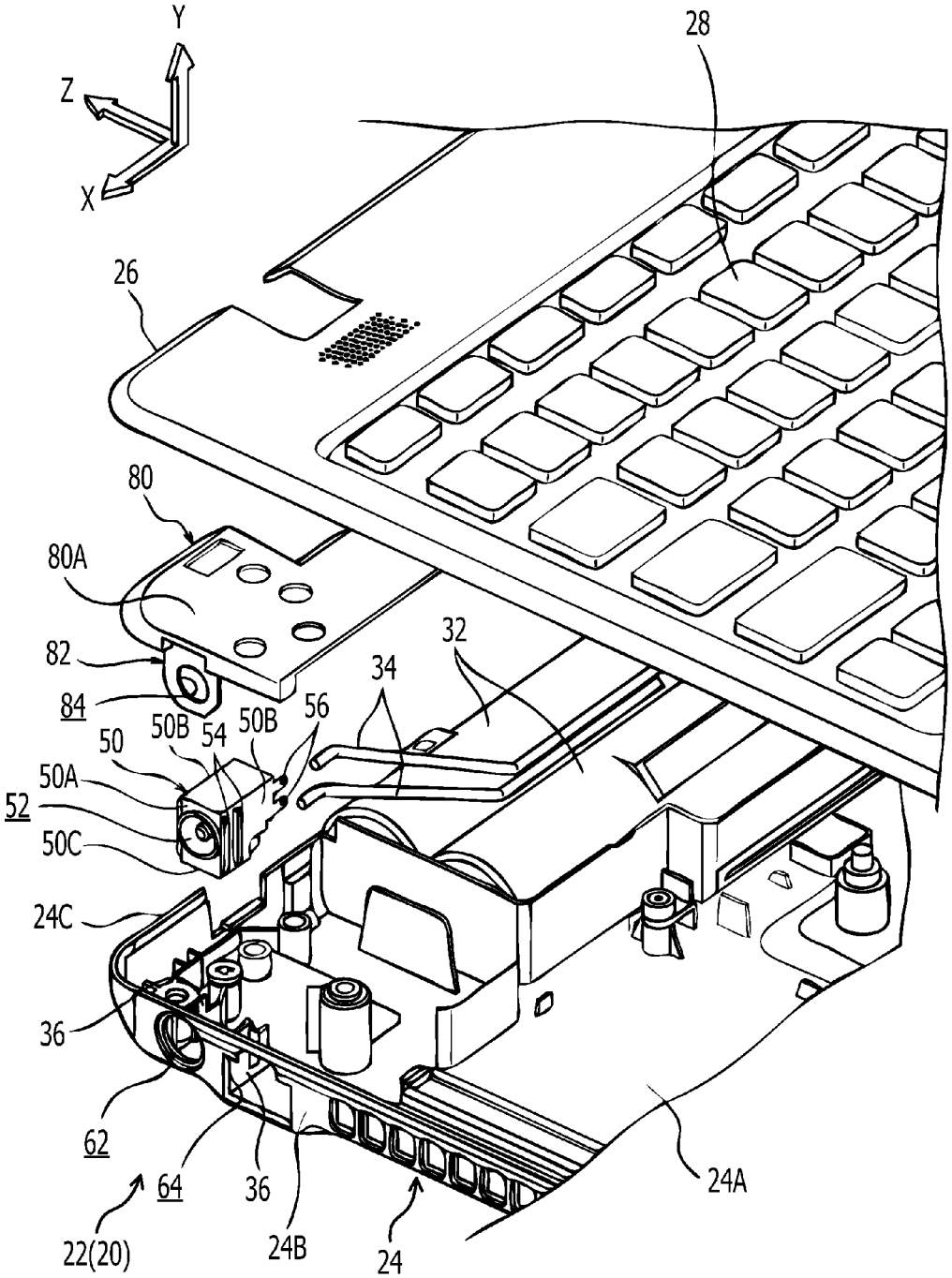
FIG. 2 illustrates an exemplary disassembled perspective diagram of a main body device.

FIG. 2 illustrates an exemplary disassembled perspective diagram of a main body device. The disassembled perspective diagram illustrated in FIG. 2 may be a disassembled perspective diagram of the main body device illustrated in FIG. 1. As illustrated in FIG. 2, the lower cover 24 includes a bottom wall part 24A and a side wall part 24B that corresponds to an outer wall part risen from an end part of the outside of the width direction of the bottom wall part 24A to the upper cover 26 side. The lower cover 24 includes a rear wall part 24C that is risen from the end part of the rear side (arrow Z direction) in the front-back direction of the bottom wall part 24A. The rear wall part 24C in the lower cover 24 stores a battery 32 that temporally stores power to be supplied to a circuit substrate, which is not illustrated. A power connector 50 is stored between the battery 32 and the side wall part 24B of the lower cover 24. For example, a cover member 80 is allocated between the battery 32 and the upper cover 26 of the power connector 50. The cover member 80 is formed with a resin member in a plate shape and stored in the housing 22 so that the longitudinal direction of the cover member 80 corresponds to the width direction of the main body device 20. The cover member 80 covers the power connector 50, the battery 32, and the like, and a speaker or the like, which is not illustrated, may be attached to the cover member 80. A stopper wall part 82 is provided in an end part 80A in the longitudinal direction of the cover member 80.

Figure 4:
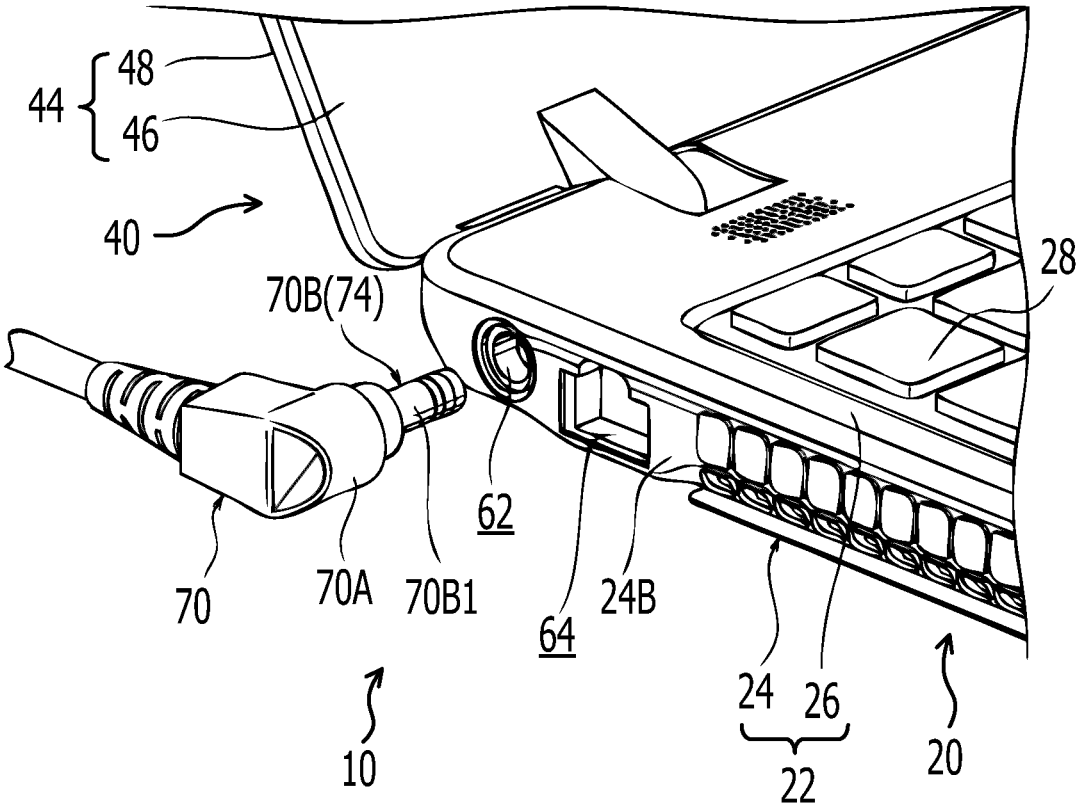
FIG. 4 illustrates an exemplary perspective diagram of a main body device.

The power connector 50 is formed in a rectangle shape viewed from the vertical direction of the main body device 20, and a front surface 50A may be provided so as to face the side wall part 24B of the lower cover 24. On the front surface 50A of the power connector 50, a coupling hole 52 having a round shape in which a plug electrode part 70B of a power plug 70 illustrated in FIG. 4 is inserted is formed.

On each side surface 50B of the power connector 50, a pair of projection parts 54 extending in the vertical direction of the main body device 20 is formed. On the side surface 50B opposite to the rear wall part 24C of the lower cover 24 in the power connector 50, a pair of cable coupling parts 56 is provided. The pair of cable coupling parts 56 is coupled to an end part of a cable 34 extending from the battery 32, respectively. The power connector 50 is electrically coupled to the battery 32 through the cables 34.

Figure 3:
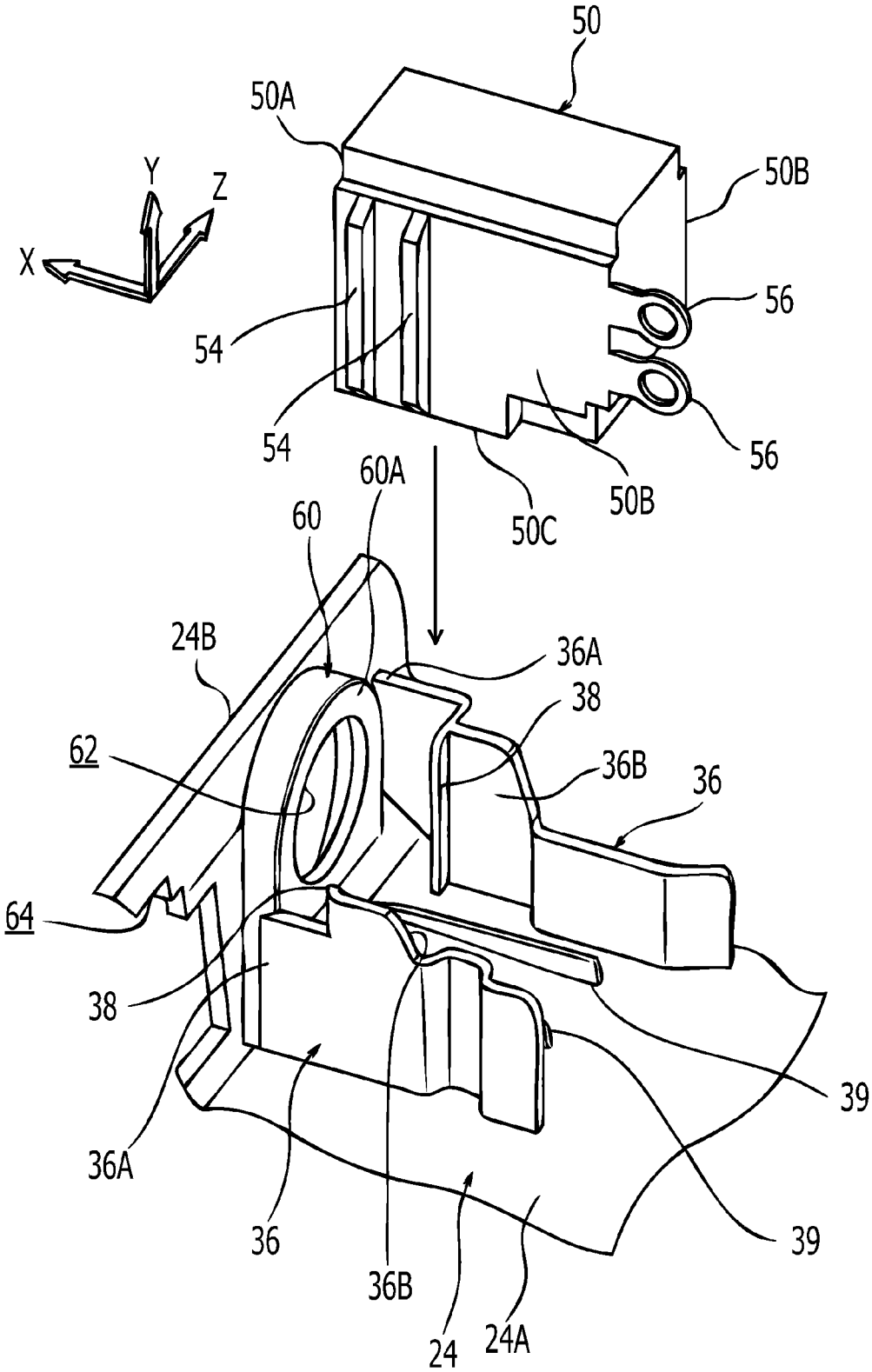
FIG. 3 illustrates an exemplary perspective diagram of a lower cover.

FIG. 3 illustrates an exemplary perspective diagram of a lower cover. The perspective diagram illustrated in FIG. 3 may be a perspective diagram viewed from another angle of the lower cover illustrated in FIG. 2. As illustrated in FIG. 3, a pair of holding wall parts 36 facing the front-back direction of the main body device 20 is formed in the lower cover 24. Each of the holding wall parts 36 is risen from the bottom wall part 24A, and an end part 36A in the width direction is integrated with the side wall part 24B of the lower cover 24. For example, each of the holding wall parts 36 is coupled to the bottom wall part 24A and the side wall part 24B of the lower cover 24 so as to be integrally formed. The lower part of the power connector 50 is provided between the pair of holding wall parts 36, so that each side surface 50B of the power connector 50 faces each of the holding wall parts 36. Therefore, the displacement of in the front-back direction (arrow Z direction) of the main body device 20 of the power connector 50 corresponding to the lower cover 24 is regulated.

On inner wall surfaces 36B of the pair of holding wall parts 36, a projection part 38 extending in the vertical direction is formed, respectively. If the power connector 50 is provided between the pair of holding wall parts 36, the projection part 38 is inserted between the pair of projection parts 54 formed on each side surface 50B of the power connector 50. Therefore, the displacement in the width direction (arrow X direction) of the main body device 20 of the power connector 50 corresponding to the lower cover 24 is regulated. In the bottom wall part 24A of the lower cover 24, a pair of lib parts 39 extending in the width direction of the main body device 20. Each of the lib parts 39 is provided between the pair of holding wall parts 36. The lib part 39 supports a lower surface 50C of the power connector 50.

In a part between the pair of holding wall parts 36 in the side wall part 24B of the lower cover 24, a concave part 60 which dents to the inner side in respect to another side wall part 24B, for example, to the power connector 50 side, is formed. If the power connector 50 is provided between the pair of holding wall parts 36, the concave part 60 faces the front surface 50A of the power connector 50 and includes a bottom part 60A that stands vertically. FIG. 4 illustrates an exemplary perspective diagram of a main body device. The perspective diagram illustrated in FIG. 4 may be a perspective diagram illustrating the side surface on the left side of the main body device illustrated in FIG. 1. As illustrated in FIG. 4, in the bottom part 60A, an insertion hole 62 into which the plug electrode part 70B of the power plug 70 is inserted. In the side wall part 24B of the lower cover 24, a cable insertion opening 64 or the like into which a communication cable, which is not illustrated, other than the insertion hole 62 may be formed.

Figure 5:
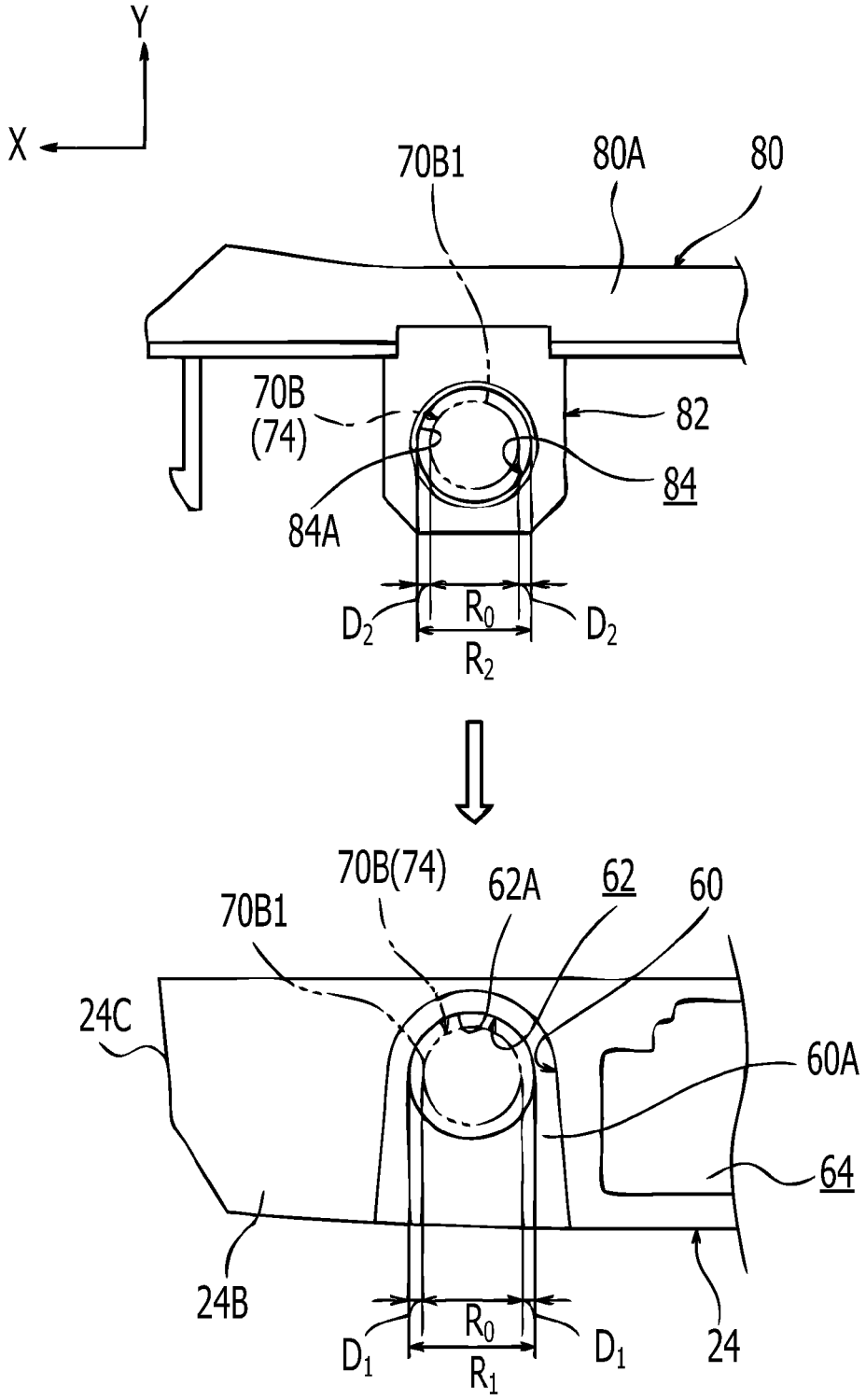
FIG. 5 illustrates an exemplary disassembled side surface diagram of a lower cover and a cover member.

FIG. 5 illustrates an exemplary disassembled side surface diagram of a lower cover and a cover member. The disassembled side surface diagram illustrated in FIG. 5 may be a disassembled side surface diagram illustrating the lower cover and the cover member illustrated in FIG. 2. As illustrated in FIG. 5, the insertion hole 62 passes through the bottom part 60A of a concave part 60 in a plate-thickness direction and may be a circular hole of which a diameter $R_1$ (external diameter) is larger than the diameter of the plug electrode part 70B of the power plug 70. For example, when the plug electrode part 70B of the power plug 70 illustrated in FIG. 6B is inserted in the insertion hole 62, a gap (space) $D_1$ is formed between an inner circumference surface 62A of the insertion hole 62 and an outer circumference surface 70B1 of the plug electrode part 70B.

Figure 6A:
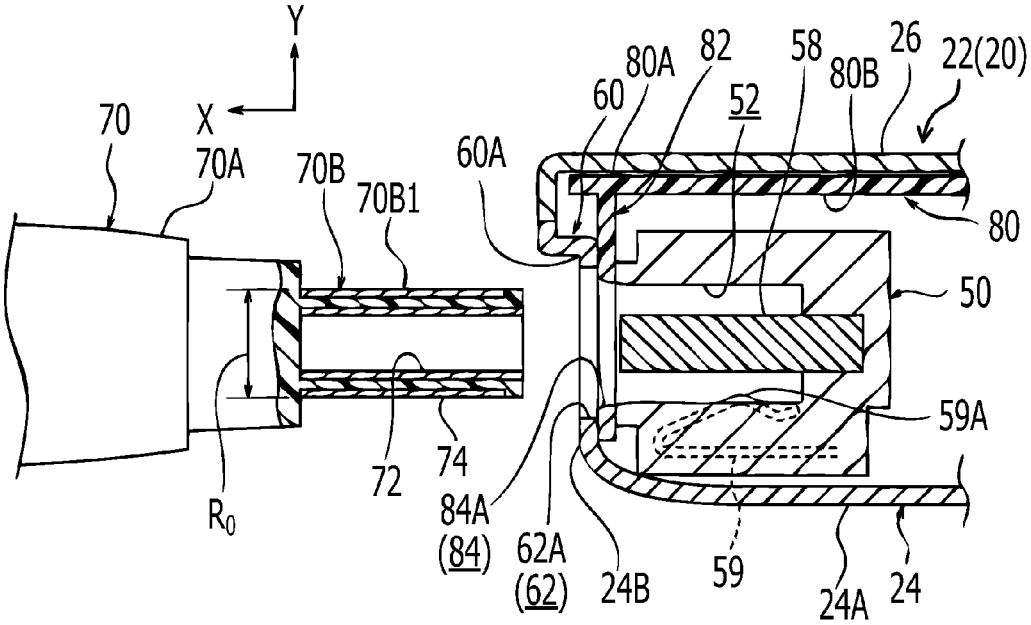
FIGS. 6A and 6B illustrate an exemplary cross-section diagram of a main body device.
Figure 6B:
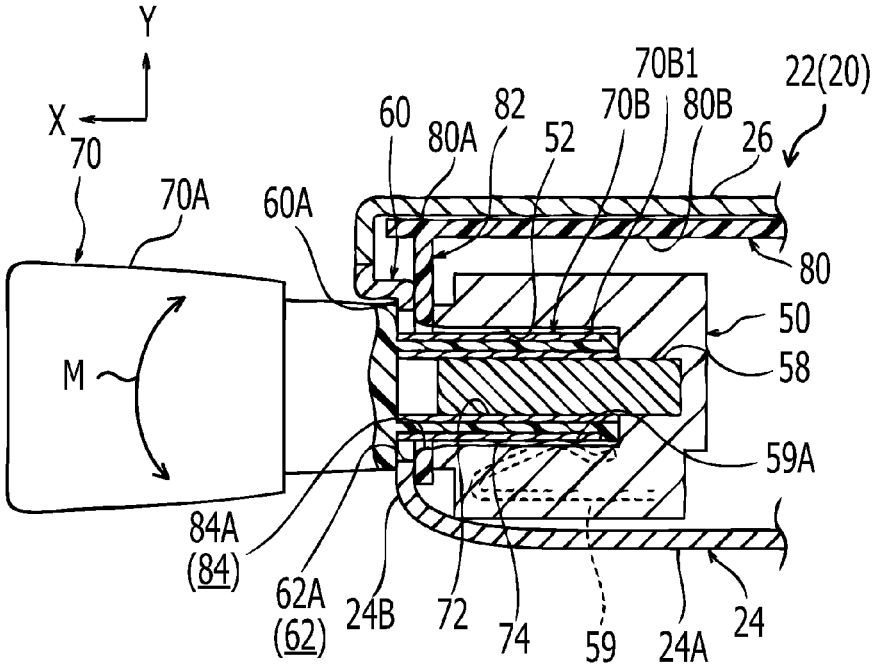

FIGS. 6A and 6B illustrate an exemplary cross-section diagram of the main body device. The cross-section diagram illustrated in FIGS. 6A and 6B may be a cross-section diagram along the width direction of the main body device illustrated in FIG. 1. FIG. 6A illustrates a state in which the plug electrode part of the power plug is not yet inserted into the power connector. FIG. 6B may illustrate a state in which the plug electrode part of the power plug is inserted into the power connector. As illustrated in FIGS. 6A and 6B, the insertion hole 62 is coaxially positioned with the coupling hole 52 of the power connector 50 provided between the pair of holding wall parts 36. For example, the power connector 50 is stored in the lower cover 24 so that the coupling hole 52 of the power connector 50 is coaxially positioned with the insertion hole 62. Therefore, the plug electrode part 70B of the power plug 70 illustrated in FIG. 7B is inserted into the coupling hole 52 of the power connector 50 through the insertion hole 62.

The power plug 70 includes a connector main body part 70A and the plug electrode part 70B that is projecting from the connector main body part 70A. The plug electrode part 70B is formed in a cylindrical shape with an external diameter $R_0$. The plug electrode part 70B includes an inner electrode part 72 on the inner side thereof and an outer electrode part 74 on the outer side thereof. The outer electrode part 74 may correspond to the outer circumference surface 70B1 of the plug electrode part 70B.

A first connector electrode part 58 formed in a circular cylindrical shape is provided in the coupling hole 52 of the power connector 50. The first connector electrode part 58 is coaxially allocated with the coupling hole 52. Therefore, when the plug electrode part 70B of the power plug 70 is inserted into the coupling hole 52 of the power connector 50, the first connector electrode part 58 is inserted into the plug electrode part 70B, and the outer circumference surface of the first connector electrode part 58 touches the inner electrode part 72 on the inner side of the plug electrode part 70B.

A second connector electrode part 59 is provided in the power connector 50. The second connector electrode part 59 having a leaf spring curved in a V-shape is provided outside a radial direction of the coupling hole 52. In an end part of the second connector electrode part 59, a touching part 59A that exposes to the coupling hole 52 and touches the outer electrode part 74 of the plug electrode part 70B inserted into the coupling hole 52 is provided. The inner electrode part 72 and the outer electrode part 74 of the plug electrode part 70B touch the first connector electrode part 58 and the second connector electrode part 59, respectively. Thus, the power plug 70 is electrically coupled to the power connector 50. The power is supplied to the battery 32 from the power connector 50 through the cable 34 (see FIG. 2) coupled to the cable coupling part 56 of the power connector 50.

The cover member 80 is provided between the power connector 50 and the upper cover 26. The cover member 80 is provided so as to face the bottom wall part 24A of the lower cover 24 on both sides of the power connector 50. The stopper wall part 82 is formed in the end part 80A in the longitudinal direction of the cover member 80. The stopper wall part 82 may correspond to a stopper part. The stopper wall part 82 extends in a wall shape to the bottom wall part 24A side of the lower cover 24 from the end part 80A in the longitudinal direction of the cover member 80. The stopper wall part 82 is inserted between (in the gap) the bottom part 60A of the concave part 60 formed in the side wall part 24B of the lower cover 24 and the front surface 50A of the power connector 50. As with the cover member 80, the stopper wall part 82 is formed with resin to have insulating performance.

In the stopper wall part 82, a through-hole 84 is formed as an opening through which the stopper wall part 82 passes in the plate thickness direction and the plug electrode part 70B of the power plug 70 passes. The diameter $R_2$ of the through-hole 84 (see FIG. 5) may be larger than the external diameter $R_0$ of the plug electrode part 70B of the power plug 70 ($R_0<R_2$). The through-hole 84 is coaxially provided with the insertion hole 62 formed in the side wall part 24B of the lower cover 24. Therefore, the plug electrode part 70B of the power plug 70 inserted from the insertion hole 62 is inserted into the coupling hole 52 of the power connector 50 through the through-hole 84 formed in the stopper wall part 82.

As illustrated in FIG. 5, the diameter $R_2$ of the though-hole 84 may be smaller than the diameter of the insertion hole 62 formed in the side wall part 24B of the lower cover 24 ($R_2<R_1$). For example, the through-hole 84 may have a diameter that is smaller than the diameter of the insertion hole 62. When the plug electrode part 70B of the power plug 70 is inserted into the coupling hole 52 of the power connector 50, the inner circumference surface 84A of the through-hole 84 faces the outer circumference surface 70B1 of the plug electrode part 70B. A gap $D_2$, which is smaller than the gap $D_1$ formed between the inner circumference surface 62A of the insertion hole 62 and the outer circumference surface 70B1 of the plug electrode part 70B, is formed between the inner circumference surface 84A of the through-hole 84 and the outer circumference surface 70B1 of the plug electrode part 70B. The inner circumference surface 84A of the through-hole 84 may correspond to the facing surface.

Figure 7:
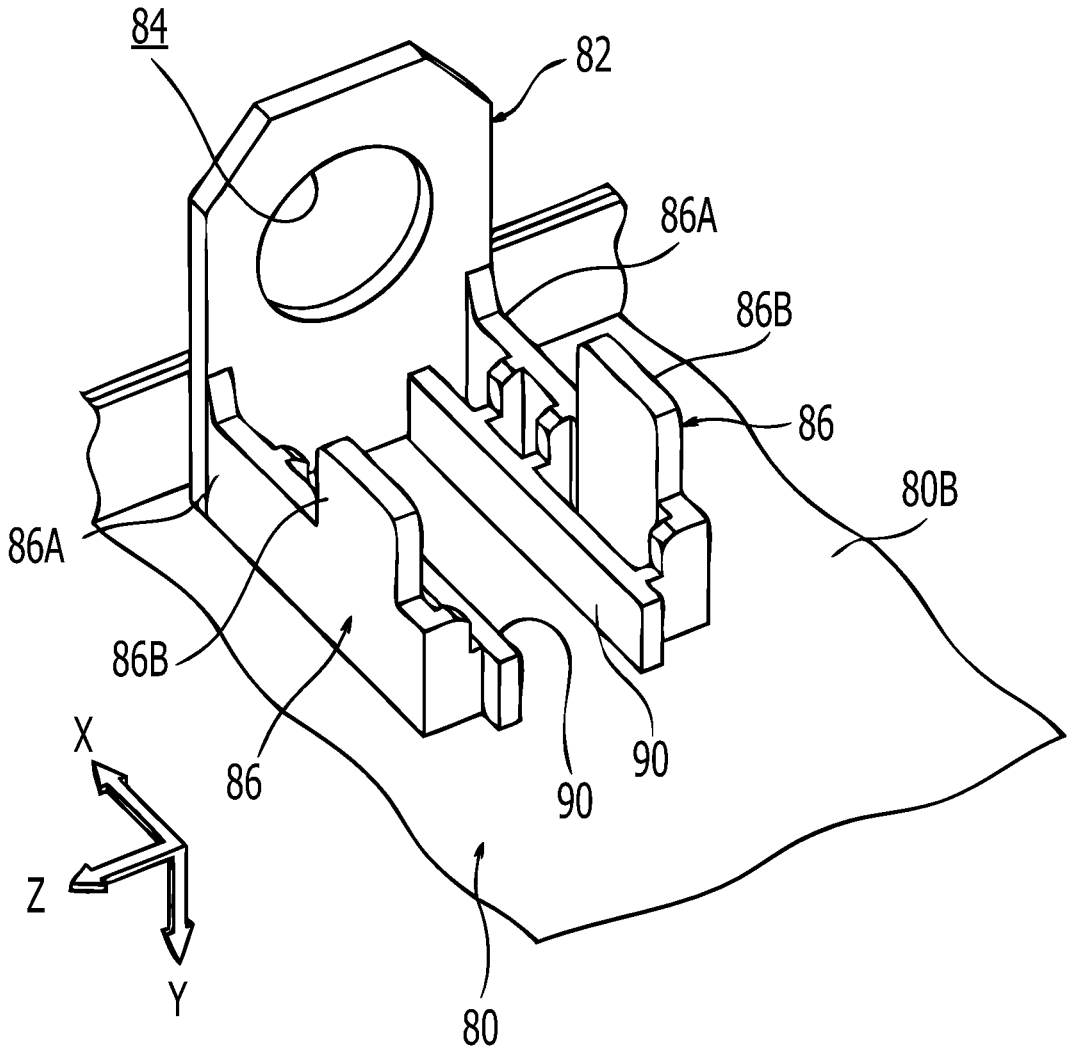
FIG. 7 illustrates an exemplary perspective diagram of a cover member.

FIG. 7 illustrates an exemplary perspective diagram of a cover member. The perspective diagram illustrated in FIG. 7 may be a perspective diagram of the end part in the longitudinal direction of the cover member illustrated in FIG. 2 viewed from the lower cover side. As illustrated in FIG. 7, in a lower surface 80B of the cover member 80, a pair of regulation wall parts 86 corresponding to the front-back direction of the main body device 20 is formed. The pair of regulation wall parts 86 may correspond to a regulation part. Each of the regulation wall parts 86 extends to the lower cover 24 (see FIG. 2) side from the lower surface 80B of the cover member 80, and the end part 86A in the width direction is integrated with the stopper wall part 82. For example, each of the regulation wall parts 86 is coupled to the lower surface 80B of the cover member 80 and the stopper wall part 82 to be integrally formed.

Figure 8:
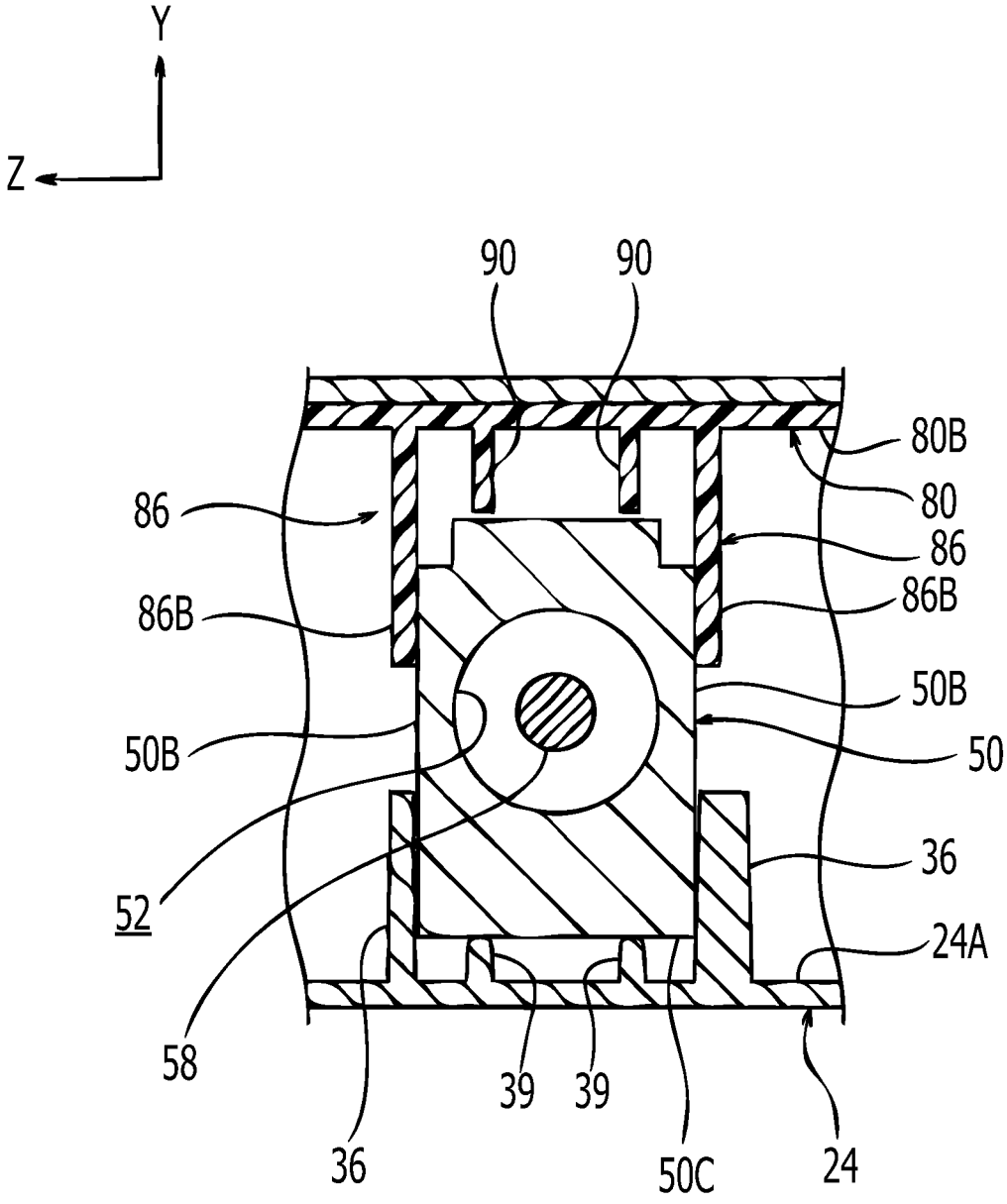
FIG. 8 illustrates an exemplary cross-section diagram of a main body device.

FIG. 8 illustrates an exemplary cross-section diagram of the main body device. The cross-section diagram illustrated in FIG. 8 may be a cross-section diagram along the front-back direction of the main body device illustrated in FIG. 1. As illustrated in FIG. 8, an extending part 86B extending to the lower cover 24 (see FIG. 2) along the side surface 50B of the power connector 50 is provided in each of the regulation wall parts 86. The upper part of the power connector 50 is provided between the extending parts 86B. Therefore, the displacement in the front-back direction (arrow Z direction) of the main body device 20 of the power connector 50 corresponding to the lower cover 24 is regulated. In the lower surface 80B of the cover member 80, a pair of lib parts 90 extending in the width direction of the main body device 20 is formed. The power connector 50 is provided between the lib part 90 and the pair of lib parts 39 formed in the bottom wall part 24A of the lower cover 24. Therefore, the displacement in the vertical direction (the arrow Y direction) of the main body device 20 of the power connector 50 corresponding to the lower cover 24 is regulated.

As illustrated in FIGS. 6A and 6B, the plug electrode part 70B of the power plug 70 is inserted into the insertion hole 62 formed in the bottom part 60A of the concave part 60 of the side wall part 24B of the lower cover 24. The plug electrode part 70B inserted into the insertion hole 62 is inserted into the coupling hole 52 of the power connector 50 through the through-hole 84 formed in the stopper wall part 82. The first connector electrode part 58 provided inside the coupling hole 52 of the power connector 50 is inserted into the plug electrode part 70B, the outer circumference surface of the first connector electrode part 58 touches the inner electrode part 72 of the plug electrode part 70B. The touching part 59A of the second connector electrode part 59 of the power connector 50 touches the outer electrode part 74 of the plug electrode part 70B. Therefore, the power plug 70 is electrically coupled to the power connector 50, and the power is supplied to the battery 32 from the power connector 50 through the cable 34 (see FIG. 2) coupled to the cable coupling part 56 of the power connector 50.

As illustrated in FIG. 6B, while the plug electrode part 70B of the power plug 70 is inserted into the coupling hole 52 of the power connector 50, the plug electrode part 70B, for example, may be displaced in the radial direction (arrow M direction). Therefore, the outer circumference surface 70B1 of the plug electrode part 70B may touch the inner circumference surface 62A of the insertion hole 62 formed in the bottom part 60A of the concave part 60 made from metal.

The stopper wall part 82 made of resin is provided between the bottom part 60A of the concave part 60 formed in the side wall part 24B of the lower cover 24 and the front surface 50A of the power connector 50. The plug electrode part 70B of the power plug 70 is inserted into the coupling hole 52 of the power connector 50 through the through-hole 84 formed in the stopper wall part 82. The gap $D_2$ is formed between a facing surface 84A of the insertion hole 84 and the outer circumference surface 70B 1 of the plug electrode part 70B. The gap $D_2$ may be smaller than the gap $D_1$ formed between the inner circumference surface 62A of the insertion hole 62 and the outer circumference surface 70B1 of the plug electrode part 70B.

While the plug electrode part 70B is inserted into the coupling hole 52 of the power connector 50, for example, even if the plug electrode part 70B is displaced in the radial direction, the outer circumference surface 70B1 of the plug electrode part 70B touches the facing surface 84A of the through-hole 84 before the inner circumference surface 62A of the insertion hole 62 touches the facing surface 84A. Since the displacement in the radial direction of the plug electrode part 70B is limited, the touch of the outer circumference surface 70B1 (the outer electrode part 74) of the plug electrode part 70B to the inner circumference surface 62A of the insertion hole 62 may be reduced.

The stopper wall part 82 is provided between the side wall part 24B of the lower cover 24 and the front surface 50A of the power connector 50. Since the stopper wall part 82 is not exposed to the outside of the housing 22, influence on the appearance of the housing 22 may be reduced.

The stopper wall part 82 is formed in the cover member 80 provided on the upper cover 26 side of the power connector 50. As illustrated in FIG. 8, the pair of regulation wall parts 86 facing the front-back direction of the main body device 20 is formed on the lower surface 80B of the cover member 80. In the pair of regulation wall parts 86, the pair of extending parts 86B extending along the side surface 50B of the power connector 50 from the lower surface 80B of the cover member 80 is formed. The extending part 86B regulates the displacement in the front-back direction of the main body device 20 of the power connector 50 corresponding to the lower cover 24. The pair of lib parts 90 is formed on the lower surface 80B of the cover member 80. The power connector 50 is provided between the lib part 90 and the pair of lib parts 39 formed in the bottom wall part 24A of the lower cover 24. Therefore, the displacement in the virtual direction of the main body device 20 of the power connector 50 corresponding to the lower cover 24 is regulated. Poor contact between the first connector electrode part 58 of the power connector 50 and the inner electrode part 72 of the plug electrode part 70B may be reduced. The poor contact between the second connector electrode part 59 of the power connector 50 and the outer electrode part 74 of the plug electrode part 70B may be reduced.

As illustrated in FIG. 7, the pair of regulation wall parts 86 is provided on both sides of the lower surface 80B of the cover member 80 and the stopper wall part 82. Since the regulation wall part 86 strengthens the stopper wall part 82, curb deformation or the like in the inserting direction of the plug electrode part 70B of the stopper wall part 82 may be reduced. The poor contact between the inner circumference surface 62A of the insertion hole 62 and the outer circumference surface 70B1 (the outer electrode part 74) of the plug electrode part 70B may be reduced.

The stopper wall part 82 and the regulation wall part 86 are formed in the cover member 80. Compared to a case where the stopper wall part 82 and the regulation wall part 86 are formed separately, the number of components of the main body device 20 may be reduced. Therefore, the assembling performance of the main body device 20 may improve.

Figure 9:
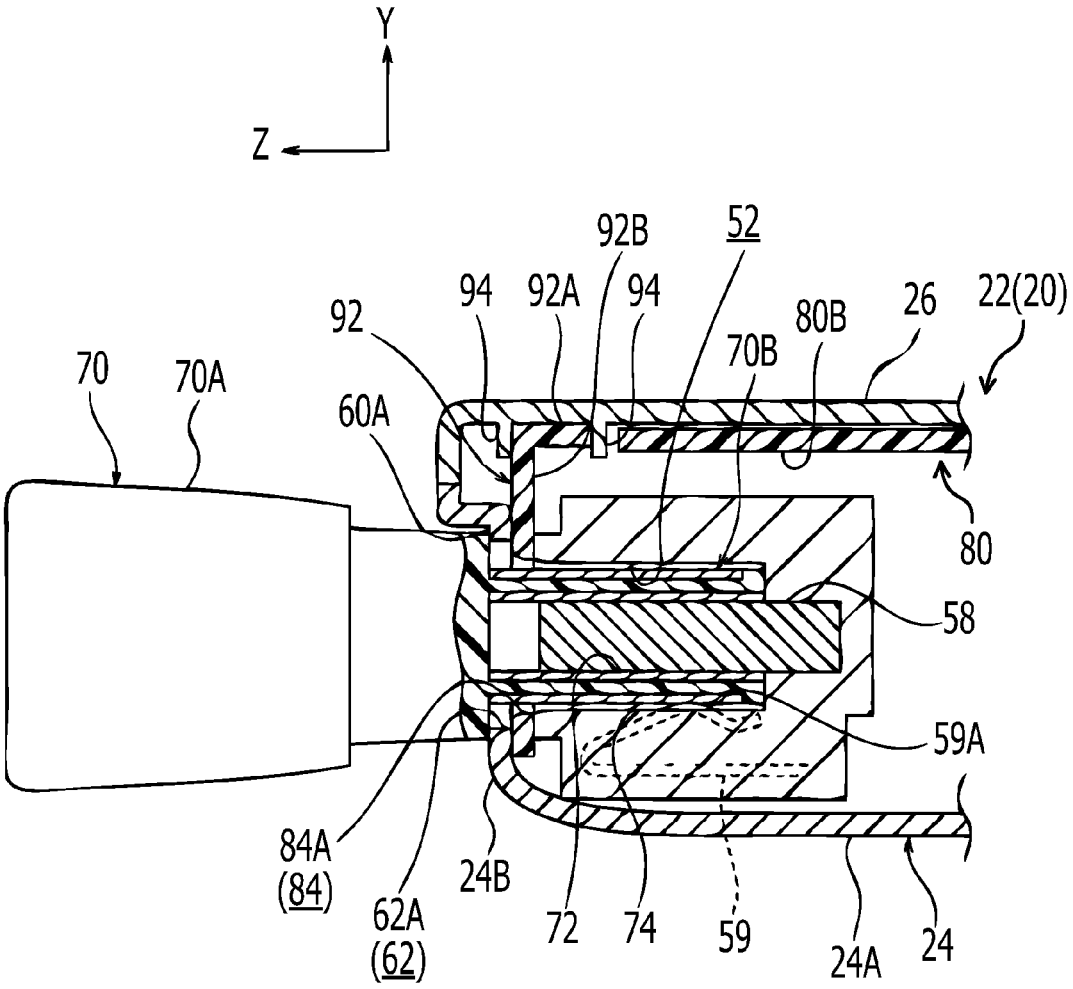
FIG. 9 illustrates an exemplary cross-section diagram of a stopper wall part.

FIG. 9 illustrates an exemplary cross-section diagram of a stopper wall part. The cross-section illustrated in FIG. 9 may be a cross-section diagram of the stopper wall part illustrated in FIG. 2. FIG. 9 illustrates a state where the plug electrode part of the power plug may be inserted into the power connector. For example, as illustrated in FIG. 9, apart from the cover member 80, a stopper member 92 may be provided. For example, the stopper member 92 is made of resin and formed in a cross-section L shape. The stopper member 92 includes a fixed part 92A that is fixed to the upper cover 26 by an adhesion material or the like. The fixed part 92A is provided between a pair of projection parts 94 formed in the upper cover 26. The displacement in the width direction (arrow X direction) of the main body device 20 of the fixed part 92A may be controlled by the projection part 94.

The stopper member 92 includes a stopper wall part 92B extending in a wall shape toward the bottom wall part 24A of the lower cover 24 from the end part on the side wall part 24B of the lower cover 24 of the fixed part 92A. The stopper wall part 92B may correspond to the stopper part. The stopper wall part 92B is inserted between the bottom part 60A of the concave part 60 formed in the side wall part 24B of the lower cover 24 and the front surface 50A of the power connector 50. In the stopper wall part 92B, the insertion hole 84 into which the plug electrode part 70B of the power plug 70 is inserted is formed. The plug electrode part 70B of the power plug 70 is inserted into the coupling hole 52 of the power connector 50 through the through-hole 84, the advantages equivalent to the above-described embodiments may be achieved. The cover member 80 may be omitted.

The circular-shaped insertion hole 84 is formed in the stopper wall part 82. In the stopper wall part 82, for example, an insertion hole in a polygonal shape such as an elliptical shape, a rectangular shape, or the like may be formed. Among the inner surfaces of the through-hole 84, the surface that is closest to the outer circumference surface 70B1 of the plug electrode part 70B of the power plug 70 may correspond to the facing surface of the stopper part. Instead of the through-hole 84, a groove formed in a U-shape of which the bottom wall part 24A side of the lower cover 24 is open may be formed in the stopper wall part 82. Among the inner surfaces of the groove, the surface, which is closest to the outer circumference surface 70B1 of the plug electrode part 70B of the power plug 70, may correspond to the facing surface of the stopper part. The opening may include an insertion hole, a groove, and the like.

The insertion hole 62 through which the plug electrode part 70B of the power plug 70 is inserted is formed in the side wall part 24B of the lower cover 24. The insertion hole 62 may be formed in the rear wall part 24C of the lower cover 24.

The electronic apparatus may be, for example, a notebook personal computer, a mobile phone, a portable DVD player, an electronic dictionary, or the like. All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. An electronic apparatus, comprising:

a housing including a metallic outer wall part on which an insertion hole to a plug electrode part of a power plug being inserted is formed, the power plug and plug electrode part being confirmed to be insertable and removable from the insertion;

a power connector which is stored in the housing and coupled to the plug electrode part inserted into the housing through the insertion hole; and an insulating stopper part which includes a facing surface facing an outer circumference surface of the plug electrode part with a gap, which is smaller than the gap between the outer circumference surface of the plug electrode part and an inner circumference surface of the insertion hole, and which is allocated between the outer wall part and the power connector.

2. The electronic apparatus according to claim 1, wherein the power connector has a connector electrode part which is coaxially allocated with the insertion hole and which is configured to be coupled to the plug electrode part inserted into the housing through the insertion hole.

3. The electronic apparatus according to claim 1, wherein the stopper part includes an opening through which the plug electrode part passes and which includes the facing surface.

4. The electronic apparatus according to claim 3, wherein the opening is a through-hole having a diameter being smaller than a diameter of the insertion hole.

5. The electronic apparatus according to claim 1, comprising:

a cover part provided on both sides of the power connector to face a bottom wall part of the housing.

6. The electronic apparatus according to claim 5, wherein the stopper part extends in a wall shape toward the bottom wall part of the housing from the cover part, and wherein the stopper part is inserted between the outer wall part and the power connector.

7. The electronic apparatus according to claim 5, wherein each of the bottom wall part of the housing and the facing cover part includes a lib part.

8. The electronic apparatus according to claim 5, comprising:

a regulation part extending along a side surface of the power connector from the cover part.

9. The electronic apparatus according to claim 8, wherein the regulation part is coupled to the cover part and the stopper part.

* * * * *